US005086578A

United States Patent [19]

Lishness et al.

[11] Patent Number: 5,086,578

[45] Date of Patent: Feb. 11, 1992

[54] SEAR POSITIONING SPRING FOR A FIREARM

[75] Inventors: Bryant L. Lishness, Bristol; Paul A. Scirica, East Hampton, both of Conn.

[73] Assignee: Colt's Manufacturing Company, Inc., West Hartford, Conn.

[21] Appl. No.: 628,345

[22] Filed: Dec. 14, 1990

[51] Int. Cl.[5] ..... F41A 19/12

[52] U.S. Cl. ..... 42/69.02; 89/144

[58] Field of Search ..... 42/69.02, 69.03, 65; 89/144, 147; 267/158

[56] References Cited

U.S. PATENT DOCUMENTS

| | | | |
|---|---|---|---|
| 24,942 | 8/1859 | Lewis et al. | 42/65 |
| 221,145 | 11/1879 | Barthel | 42/69.03 |
| 882,594 | 3/1908 | Talbot | 89/150 |
| 1,187,888 | 6/1916 | Diehm | 89/144 |
| 2,248,970 | 7/1941 | Decker et al. | 42/1.01 |
| 2,482,842 | 9/1949 | Crockett | 42/18 |
| 2,549,797 | 4/1951 | Gaidos | 42/69.02 |
| 2,659,994 | 11/1953 | Yale | 42/69 |
| 3,246,566 | 4/1966 | Ordner | 89/144 |
| 3,678,800 | 7/1972 | Seidel et al. | 29/147 |
| 4,646,619 | 3/1987 | Sokolovsky | 89/145 |
| 4,709,878 | 12/1987 | Titley | 244/3.27 |

*Primary Examiner*—Michael J. Carone

*Attorney, Agent, or Firm*—Perman & Green

[57] ABSTRACT

A spring for positioning a sear of a firearm and a method of manufacturing a firearm. The spring has a first section that is connected to the frame of the firearm, a second section that exerts a biasing force against the sear in a first direction, and a third section adapted to move in a direction relatively perpendicular to the direction of the second section. The second and third sections are preferably leaf springs and are adapted to position the sear in two positions depended upon movement of the trigger.

16 Claims, 2 Drawing Sheets

SEAR POSITIONING SPRING FOR A FIREARM

BACKGROUND OF THE INVENTION

1. Field of the Invention

The present invention relates to firearms and, more particularly, to a spring for use in a firearm.

2. Prior Art

Various types of springs are used in firearms to bias members in positions and for locking members in positions. The most common spring is the coil spring that is sometimes used with a plunger. One example of this coil spring and plunger arrangement can be seen in U.S. Pat. No. 882,594. Coil springs have also been used to position sears in firing mechanisms such as shown in U.S. Pat. No. 3,678,800. U.S. Pat. No. 4,646,619 discloses a sear assembly with a primary sear spring in the form of a leaf spring and a secondary sear spring in the form of a coil spring. U.S. Pat. No. 2,659,994 also discloses a leaf-type spring that urge the rear end of a sear bar upwardly. However, the prior art has not addressed the problem of providing a single spring that can perform more than a single function. Thus, prior art firearms usually had numerous parts resulting in increased expense in manufacturing the firearm and more parts and pieces that could become damaged.

It is therefore the objective of the present invention to provide a new and improved spring for use in a firearm that can overcome problems in the prior art and provide additional features.

SUMMARY OF THE INVENTION

The foregoing problems are overcome and other advantages are provided by a new and improved spring for use in a firearm.

In accordance with one embodiment of the present invention, a sear locating spring for use with a firearm having a sear movable in two directions is provided. The spring comprises a first section, a second section, and a third section. The first section is adapted to be fixedly connected to a frame of a firearm. The second section is connected to the first section and is adapted to insert a biasing force against the sear in a first direction. The third section is connected to the first section and is adapted to move in a second direction relatively perpendicular to the first direction.

In accordance with one method of the present invention, a method of manufacturing a firearm is provided. The method comprises the steps of providing a frame, a barrel, a firing pin assembly, and a trigger assembly. The trigger assembly has a longitudinal sear pivotally connected to a trigger and being longitudinally movable therewith. The method further comprises providing a sear locating spring. The spring has a first spring portion adapted to bias the sear in a first path of motion for a first predetermined range of motion and, a second spring portion adapted to retain the sear in a location other than the first path of motion for a second predetermined range of motion of the sear. The method further comprises connecting the sear locating spring to the frame.

In accordance with another embodiment of the present invention, a firing pin mechanism is provided having a firing pin assembly, a trigger assembly, and a sear locating spring. The firing pin assembly has a sear surface adapted to be engaged by and disengaged from a sear. The trigger assembly has a trigger and the sear. The sear is pivotally connected to the trigger and adapted to longitudinally move therewith. The sear locating spring has a first spring portion adapted to biasingly prevent the sear from pivoting relative to the trigger for a first predetermined range of motion of the sear, and a second portion adapted to limit pivotal motion of the sear relative to the trigger for a second predetermined range of motion of the sear.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
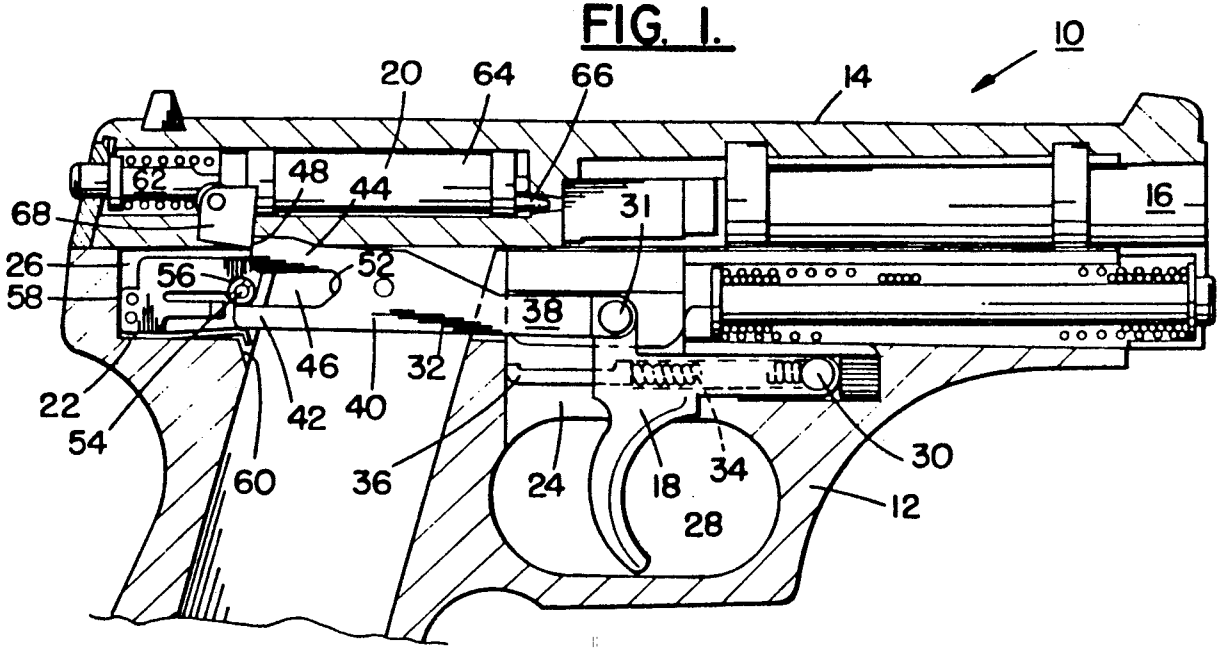
FIG. 1 is a schematic cross-sectional view of a pistol incorporating features of the present invention.

Referring to FIG. 1, there is shown a partial cross-sectional view of a pistol 10 incorporating features of the present invention. Although the present invention will be described with reference to the embodiments shown in the drawings, it should be understood that the present invention can be incorporated into different types of embodiments and may be used with different types of firearms and trigger assemblies. In addition, any suitable size, shape and type of elements or materials could be used.

The pistol 10 generally comprises a frame 12, a slide 14, a barrel 16, a trigger assembly 18, and a firing pin assembly 20. The pistol 10 is similar to a pistol disclosed in U.S. Pat. application Ser. No. 447,601 filed Dec. 8, 1989 which is incorporated by reference in its entirety herein. Fixedly connected to the frame 12 and operably positioned relative to the trigger assembly 18 is a sear locating or positioning spring 22. Before describing the spring 22 and its operation, it is necessary to describe the other elements of the pistol 10 in more detail.

The frame 12 may be comprised of any suitable material such as metal or plastic. The frame 12 has a trigger cavity 24 and a sear cavity 26. The trigger assembly 18 comprises a trigger 28, roller bearings 30 and 31, and sear 32. The trigger 28 is movably mounted in the trigger cavity 24 for linear longitudinal movement therein supported by roller bearings 30 and 31. Spring 34 and plunger 36 bias the trigger 28 in a forward position. The sear 32 is pivotally connected to the trigger 28 at roller bearing 31.

Figure 6:
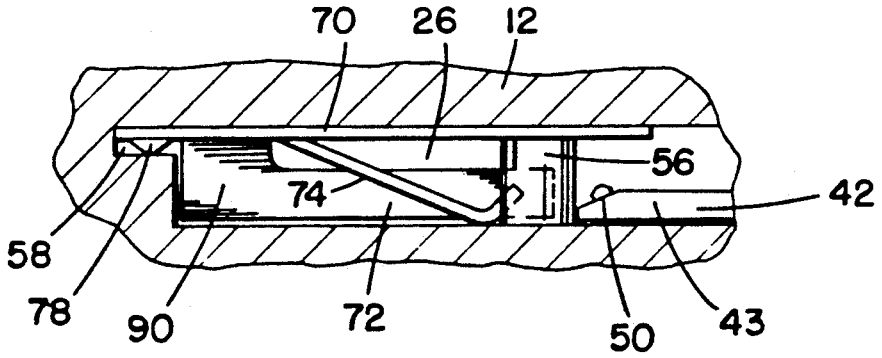
FIG. 6 is a partial schematic top cross-sectional view of the sear positioning spring and roller in the frame.

The sear 32 generally comprises a first forward section 38 connected to the trigger 28 and a second rearward section 40 having a bottom leg 42, a top leg 44, and a groove 46 therebetween. The top leg 44 has a sear surface 48. The bottom leg 42 has a spring ramp 50 on one side (see FIG. 6). The rearward section 40 also has a roller cam surface 52 in the groove 46. The sear 32 is adapted to longitudinally move with the trigger 28, but can be pivoted relative thereto proximate roller bearing 31. Fixedly mounted to the frame 12 in the sear cavity 26 is a roller pin 54 with a cam roller 56 connected thereto. The rearward section 40 of the sear 32 is operably positioned in the sear cavity 24 such that the sear 32 can move relative to the roller 56 with the roller 56 in the groove 46. The sear cavity 24 also has a rear slot 58 (see FIG. 6) for the sear spring 22 and a ledge 60 for purposes as will be described below.

The firing pin assembly 20 has a spring unit 62, an outer case 64, a firing pin 66 at the front of the case 64, and a sear 68 connected to the case 64. The sear 68 can be moved back by the sear 32 as the trigger 28 is pulled. The sear 68, in turn, can move the case 64 and firing pin 66 therewith. When the two sears 32 and 68 are disengaged from each other, the spring unit 62 can propel the case 64 and firing pin 66 forward to contact and fire a cartridge.

Figure 2:
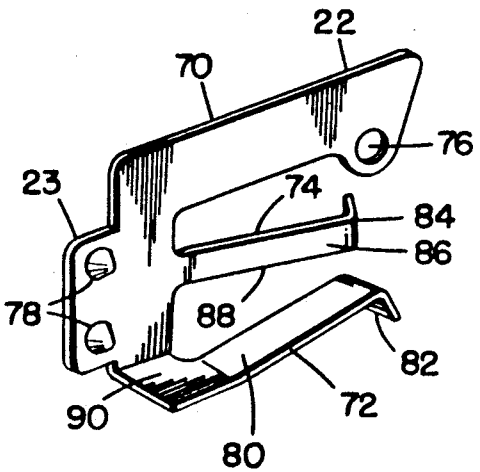
FIG. 2 is a perspective view of a sear positioning spring shown in the pistol of FIG. 1.

Referring now also to FIG. 2, a perspective view of the spring 22 is shown. The spring 22 generally has three sections; a first main section 70, a second section 72 and a third section 74. In the preferred embodiment shown, the spring 22 is comprised of a sheet of metal that has been stamped to form the shape shown. However, any suitable material or shape could be used. The main section 70, in the embodiment shown, is relatively flat with a pin hole 76 at a first end and projections in the form of dimples 78 at a rear end. The second section 72 extends from the main section 70 and forms a leaf spring with a top surface 80 and a front ramp 82. The top surface 80 is generally perpendicular to the plane of the main section 70. The third section 74 also extends from the main section 70 and forms a leaf spring. However, the third section 74 is relatively perpendicular to the second section 72. The third section 74 generally has a front ramp 84, a side surface 86, and a bottom edge 88. In an alternate embodiment, the spring 22 may be comprised of multiple members that are connected to each other.

The main body section 70 is generally provided to fixedly mount the spring 22 to the frame 12 and support the spring sections 72 and 74 on the frame. The pin hole 76 has the roller pin 54 mounted therein and the roller 56 is positioned on one side of the main body section 70 to sandwich the main section 70 between a side wall of the frame 12 in the sear cavity 26 and the roller 56. The rear end 23 of the main section 70 is mounted in the slot 58 (see FIG. 6) with the dimples 78 fixedly mounting the rear end 23 therein. The main section 70 also has a bent section 90 that rests on the bottom wall of the sear cavity 26 and which the spring section 72 extends forward therefrom.

Figure 3:
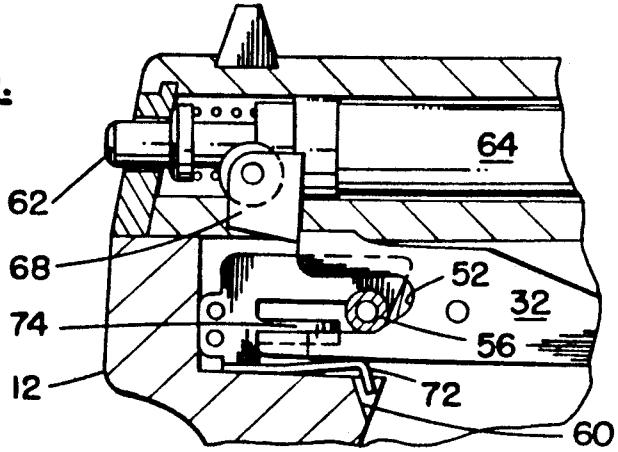
FIG. 3 is an enlarged partial cross-sectional view of the pistol shown in FIG. 1 with the sear at a second position.
Figure 4:
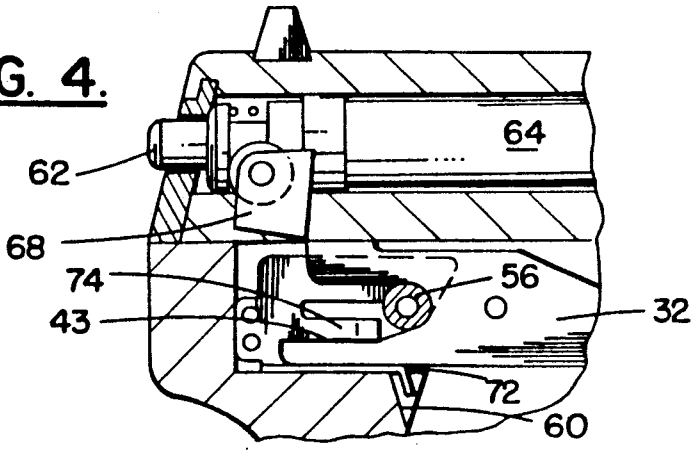
FIG. 4 is an enlarged partial cross-sectional view of the pistol as shown in FIG. 3 with the sear at a third position.

As the trigger 28 is pulled back from a forward position as shown in FIG. 1, the top leg 44 of the sear 32 contacts the sear 68, and the top surface of the bottom leg 42 is biased upward by the bottom leaf spring section 72 against the roller 56. The trigger 28 can be further pulled back with the sear 32 moving in registry therewith. The firing pin assembly sear 68, case 64 and firing pin 66 are thus moved back. The lower leg ramp 50 (see FIG. 6) pushes and deflects the side leaf spring section 74 out of the way of the path of the lower leg 42. During this first path of motion of the sear 32, the roller 56 contacts the roller cam surface 52 as shown in FIG. 3. As the trigger 28 is further pulled, the roller 56 and cam surface 52 cooperate to move or pivot the sear 32 downward, pivoting at the trigger 28. During this downward and rearward motion of the rear section 40 of the sear 32, the bottom leaf spring section 72 is deflected down as shown in FIG. 4. The forward tip of the bottom leaf spring section 72 is allowed to deflect in front of ledge 60.

Because the entire rear section 40 of the sear 32 is moved down, the top surface 43 of the bottom leg 42 is also moved down. This allows the side spring section 74 to snap into the groove 46 with the bottom edge 88 on top of the bottom leg top surface 43 as shown in FIG. 4. In a preferred embodiment, the position of the sear 32 at this side leaf spring engagement is also the release position between the sear surface 48 and the firing pin assembly sear 68. Thus, the case 64, sear 68, and firing pin 66 are propelled forward by the spring unit 62 to fire a cartridge.

Figure 5:
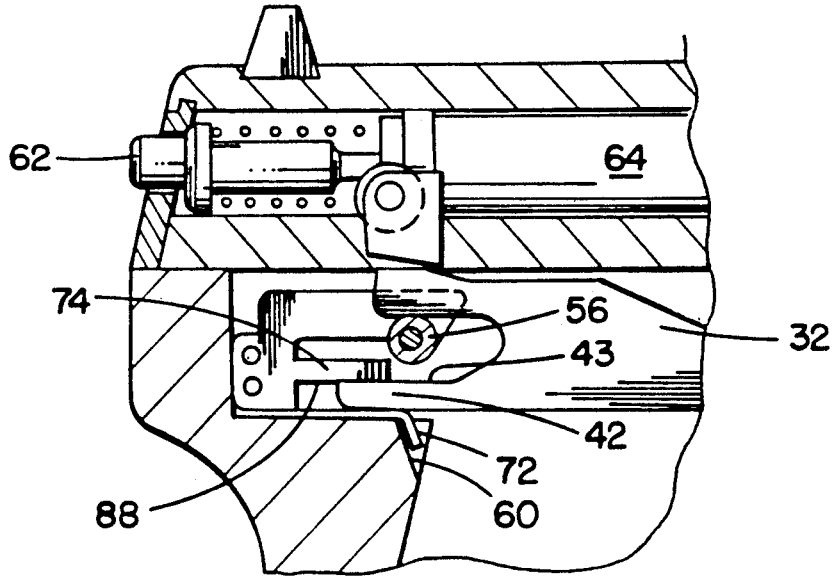
FIG. 5 is an enlarged partial cross-sectional view of the pistol as shown in FIG. 4 with the sear at a fourth position.

Referring now also to FIG. 5, after the pistol is fired, the trigger 28 must be returned to its forward position before the pistol can be fired again. The side leaf spring section 74 accomplishes this function. From its position as shown in FIG. 4, the sear 32 can be moved forward with the trigger 28, however, because of the positioning of the side leaf spring section 74 over the top surface 43 of the bottom leg 42, the bottom leg 42 is retained in its down position during the return path of the sear 32. This prevents the top leg 44 of the sear from engaging the firing pin assembly sear 68 unless and until the trigger has been fully returned to its forward position. Thus, a full stroke trigger safety is provided. Upon the full forward movement of the trigger 28 and sear 32, the rear of the bottom leg 42 passes the side leaf spring section 74 and thus releases the bottom leg 42. The bottom leaf spring section 72, with the bottom leg 42 released from the side leaf spring section 74, biases the sear 32 back to its up position as shown in FIG. 1.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A sear locating spring for use with a firearm, the firearm having a sear movable in two directions, the spring comprising:
   - a first section adapted to be fixedly connected to a frame of the firearm;
   - a second section connected to said first section and adapted to exert a biasing force against the sear in a first direction; and
   - a third section connected to said first section and adapted to move in a second direction relatively perpendicular to said first direction.

2. A spring as in claim 1 wherein said first, second and third sections are comprised of a single unitary member.

3. A spring as in claim 2 wherein said member is comprised of a stamped sheet of metal.

4. A spring as in claim 1 wherein said second section is a cantilever spring section extending from said first section.

5. A spring as in claim 1 wherein said third section is a cantilever spring section extending from said first section.

6. A spring as in claim 1 wherein said third section is located above said second section.

7. A spring as in claim 1 wherein said first section comprises projections to fixedly connect the spring to a firearm frame.

8. A method of manufacturing a firearm comprising steps of:

providing a frame, a barrel, a firing pin assembly and a trigger assembly, the trigger assembly having a longitudinal sear pivotally connected to a trigger and being longitudinally movable therewith;

providing a sear locating spring, the spring having a first spring portion adapted to bias the sear in a first path of motion for a first predetermined range of motion and, a second spring portion adapted to retain the sear in a location other than the first path of motion for a second predetermined range of motion of the sear; and connecting the sear locating spring to the frame.

9. A method as in claim 8 wherein the step of providing a sear locating spring-comprises stamping a sheet of metal to form the spring.

10. A method as in claim 8 wherein the step of providing a sear locating spring comprises forming the spring with a main section and the first spring portion as a cantilever leaf spring extending from the main section.

11. A method as in claim 8 wherein the step of providing a sear locating spring comprises forming the spring with a main section and the second spring portion as a cantilever leaf spring extending from the main section.

12. A firing mechanism comprising:

a firing pin assembly having a sear surface adapted to be engaged by and disengaged from a sear;

a trigger assembly having a trigger and the sear, the sear being pivotally connected to the trigger and adapted to longitudinally move therewith; and a sear locating spring having a first spring portion adapted to biasingly prevent the sear from pivoting relative to the trigger for a first predetermined range of motion of the sear, and a second portion adapted to limit pivotal movement of the sear relative to the trigger for a second predetermined range of motion of the sear.

13. A firing mechanism as in claim 12 wherein the sear locating spring is comprised of a main section with the first and second portions extending therefrom.

14. A firing mechanism as in claim 13 wherein the first and second portions are both leaf springs.

15. A firing mechanism as in claim 14 wherein the first and second portions extend in directions transverse to each other.

16. A firearm comprising:

a frame;

a barrel connected to the frame; and a firing mechanism having a trigger assembly including a trigger, a sear, and a sear locating spring, the spring having a first portion adapted to prevent the sear from moving relative to the trigger for a first predetermined range of motion of the sear and, a second portion adapted to limit movement of the sear relative to the trigger for a second predetermined range of motion of the sear.

* * * * *